US009426873B2

(12) United States Patent
Casper et al.

(10) Patent No.: US 9,426,873 B2
(45) Date of Patent: Aug. 23, 2016

(54) SYSTEM AND METHOD OF DETERMINING EFFECTIVE GLOW DISCHARGE LAMP CURRENT

(71) Applicant: Leco Corporation, St. Joseph, MI (US)

(72) Inventors: Ted J Casper, West Bend, WI (US); Sara K Casper, West Bend, WI (US); Kim Marshall, St. Joseph, MI (US)

(73) Assignee: Leco Corporation, St. Joseph, MI (US)

( * ) Notice: Subject to any disclaimer, the term of this patent is extended or adjusted under 35 U.S.C. 154(b) by 267 days.

(21) Appl. No.: 14/012,760

(22) Filed: Aug. 28, 2013

(65) Prior Publication Data

US 2014/0062306 A1 Mar. 6, 2014

Related U.S. Application Data

(60) Provisional application No. 61/693,941, filed on Aug. 28, 2012.

(51) Int. Cl.
*H05H 1/02* (2006.01)
*H05H 1/00* (2006.01)

(52) U.S. Cl.
CPC ..... *H05H 1/02* (2013.01); *H05H 1/0081* (2013.01)

(58) Field of Classification Search
CPC ..... H05H 1/00; H05H 1/02; H05H 1/24; H05H 1/0081; H05H 1/46; H01J 15/00; H01J 61/62; H05G 2/001
USPC ..... 315/291, 111.01
See application file for complete search history.

(56) References Cited

U.S. PATENT DOCUMENTS 6,822,229 B2 11/2004 Wilken et al.
2010/0289429 A1* 11/2010 Pollmann-Retsch ..... H05B 41/2928 315/307

OTHER PUBLICATIONS

Wilken, L. et al., "Development of a radio-frequency glow discharge source with integrated voltage and current probes," Leibniz Institute for Solid State and Materials Research, Dresden, Germany, Published Feb. 26, 2003.
Wilken, L. et al., "Radio frequency glow discharge source with integrated voltage and current probes used for evaluation of discharge parameters," Journal of Applied Physics 99, 063305 (2006).
Wilken, L. et al., "Electrical measurements at radio frequency glow discharges for spectroscopy," Spectrochimica Acta Part B 62 (2007) pp. 1085-1122.
Marshall, K. A., et al., "The analytical impact of power control in a radio frequency glow discharge optical emission plasma," J. Anal. At. Spectrom, 2003, 18, pp. 637-645.
Kohler, K., et al., "Plasma potentials of 13.56-MHz rf argon glow discharges in a planar system," J. Appl. Phys. 57 (1), Jan. 1, 1985.
Belenguer, Ph. et al., "Electrical Characterization of radiofrequency glow discharge used for optical emission spectroscopy.", pp. 604-610, Jul. 2003, John Wiley & Sons, Surface and Interface Analysis.†

* cited by examiner
† cited by third party

*Primary Examiner* — Jimmy Vu
*Assistant Examiner* — Henry Luong
(74) *Attorney, Agent, or Firm* — Price Heneveld LLP

(57) ABSTRACT

The embodiments of the invention include a method for controlling plasma conditions of a glow discharge system using the integrated electron (or ion) pulse area extracted from the total lamp current. The method of using an integrated electron/ion pulse area for controlling plasma conditions allows for controlled analysis of conductive, non-conductive and layered materials without the need for estimation of plasma voltages. The method allows for control of sputter rates and plasma emissions that cannot be achieved using other methods such as capacitive divider calculations where actual thicknesses and dielectric constants are not known or predefined.

17 Claims, 12 Drawing Sheets

Integrated Electron Pulse Area vs Effective Plasma Power - 1kV Effective Voltage, Steel

Product of Effective Voltage and Integrated Electron Pulse Area vs Effective Plasma Power - Steel Sample at 5 Torr Effective Current vs Integrated Electron Pulse Area, Steel 7.4 Watt effective power, 7.4mA effective DC and RF Lamp Pressure Comparision for Various Materials Note: Effective RF current determined by integrated electron pulse area

SYSTEM AND METHOD OF DETERMINING EFFECTIVE GLOW DISCHARGE LAMP CURRENT

CROSS-REFERENCE TO RELATED APPLICATION

This application claims priority to U.S. Patent Provisional Application No. 61/693,941 filed on Aug. 28, 2012, entitled "METHOD OF DETERMINING EFFECTIVE GLOW DISCHARGE LAMP CURRENT," which is incorporated herein by reference.

FIELD OF THE INVENTION

The present invention generally relates to the field of glow discharge mass spectrometry or optical emission spectrometry using a radio frequency (RF) power supply to power the glow discharge lamp or source. A method for determining the effective lamp current from the total lamp current and its use in controlling the source are described.

BACKGROUND OF THE INVENTION

A glow discharge lamp is an electro-mechanical structure that allows creation of a plasma or ionized gas. The plasma formed in the glow discharge lamp is commonly referred to as a "glow discharge." A glow discharge has applications including the bulk and composition depth profile (CDP) analysis of various materials by using the plasma for sputtering of the sample material. For these types of applications, control of the glow discharge is significant to obtain meaningful results. Methods of creating a glow discharge include the application of direct current (DC) or radio frequency (RF) energy to the glow discharge lamp. When a sample material is nonconductive, RF energy should be used.

Three electrical parameters, voltage, current, and power are measurable in a DC glow discharge. To accurately control a glow discharge, two of the three electrical parameters should be managed or measured for proper interpretation of the analytical results. The third electrical parameter can be calculated from the quotient or product of the other two. The ratio of voltage to current in the glow discharge has a direct influence on sputter rate and light emission. Power can also be utilized to control or predict sputter rate and light emission, but accuracy is improved if either the voltage or current is also determined. Sputter rate control is important when performing CDP analysis of a multilayer material as one of the goals is measurement of the various layers' thicknesses. To accomplish control of the sputter rate, it is typical for the glow discharge lamp pressure to be altered to achieve the desired voltage to current ratio at a given power level. In a glow discharge, increasing lamp pressure relative to absolute vacuum results in a lowering of the plasma impedance or plasma voltage to current ratio as more gas molecules are present for ionization.

When the glow discharge is driven with alternating current (AC) or RF power, it is convenient to compare electrical parameters with their DC equivalent values. The term "effective" is used to describe an amount of AC or RF stimulus that produces the same effect as a DC stimulus of the same magnitude. For example, in an RF system, effective plasma current refers to the amount of plasma current that must be applied to obtain the same effect as that obtained with an equal amount of DC current. In a DC glow discharge, effective electrical values are equal to the static potentials or currents applied.

Quantitative or composition RF glow discharge has historically been problematic due to deficiencies in the ability to precisely measure RF electrical parameters of the discharge. Effective voltage is the voltage at the sample surface where the plasma is present. Effective lamp voltage is the voltage measured at the RF electrode point of measurement. For example, effective voltage is only measureable for conductive samples since a nonconductor forms a capacitive divider between the RF electrode point of measurement and the actual voltage potential present at the sample surface and experienced by the plasma. Effective lamp voltage is equal to effective voltage only when the sample is conductive. Total lamp currents in an RF glow discharge lamp are complex comprising of capacitive sinusoidal currents as well as discharge-related sinusoidal and non-sinusoidal currents. The capacitive currents are developed from the mechanical structure used to create or confine the discharge structure or lamp. The complex plasma current comprised of both ion and electron current was described by H. S. Kino and G. S. Butler in "Plasma Sheath Formation by Radio-Frequency Fields," *The Physics of Fluids*, Vol. 6, No. 9, September 1963, pp. 1346-1355. Techniques for measuring the current of an RF glow discharge lamp for elemental analysis are detailed by Ludger Wilken, Volker Hoffmann, Peter Geisler, and Klaus Wetzig (2004, Nov. 23) in U.S. Pat. No. 6,822,229. Wilken applied techniques for current, power and impedance measurement developed by C. Beneking (1990, Nov. 1), in "Power dissipation in capacitively coupled rf discharges," *J. Appl. Phys,* 68 (9), pp. 4461-4473 to an RF glow discharge lamp used for elemental analysis.

RF power measurements should account for system losses and variation in operational voltages. There are multiple methods for determining the effective plasma power including True Plasma Power™ (TPP) also known as effective power (EP) described by K. A. Marshall, T. J. Casper, K. R. Brushwyler, and J. C. Mitchell (2003) in "The analytical impact of power control in a radio frequency glow discharge optical emission plasma," *J. Anal. At. Spectrom* 18, pp. 637-645 or a vector multiplication technique implemented by L. Wilken, V. Hoffmann, H. J. Uhlemann, H. Siegel, and K. Wetzig (26 Feb. 2003 on Web) in "Development of a Radio-Frequency Glow Discharge Source with Integrated Voltage and Current Probes," *JAAS.*

Although conductive sample sputter rate correlation between RF and DC conditions is possible, see K. A. Marshall, T. J. Casper, K. R. Brushwyler, and J. C. Mitchell (2003), "The analytical impact of power control in a radio frequency glow discharge optical emission plasma," *J. Anal. At. Spectrom* 18, 637-645, the ability to directly determine the effective RF plasma voltage or current for nonconductive samples or thin nonconductive layers has not been realized. Attempts to calculate the effective voltage based on sample capacitance have been demonstrated, but this method requires knowledge of the dielectric types and thicknesses involved, see L. Wilken, V. Hoffmann, and K. Wetzig (2005, Jun. 11), "Radio frequency glow discharge source with integrated voltage and current probes used for sputtering rate and emission yield measurements at insulating samples," *Anal Bioanal Chem, pp.* 424-433 and L. Wilken, V. Hoffmann, and K. Wetzig (2007), "Electrical measurements at radio frequency glow discharges for spectroscopy," *Spectrochimica Acta Part B,* 1085-1122.

The methods developed previously can only determine effective plasma power for both conductive and nonconductive samples. Effective voltage can only be measured for conductive samples. Although effective current can be calculated from the quotient of effective power divided by effective voltage, a method for determination of effective current from total lamp current has yet to be realized. The inability to measure the effective voltage or current for all sample types limits the capability to fully control the plasma, thereby placing limitations on the types of samples that can be accurately analyzed in both bulk and CDP experiments.

SUMMARY OF THE INVENTION

According to one embodiment of the present invention, a glow discharge lamp system is provided that comprises: a glow discharge lamp for ionizing a sample of a material to be analyzed into a plasma; a variable valve for adjusting a pressure of the glow discharge lamp in response to a lamp pressure control signal; a lamp current sensor for sensing a total lamp current and generating a total lamp current signal representative of the total lamp current over time; and a processor for receiving the total lamp current signal from the lamp current sensor and for supplying the lamp pressure control signal to the variable valve, wherein the processor determines an integrated pulse area of a pulse contained within the total lamp current signal and adjusts the pressure of the glow discharge lamp in response to the integrated pulse area, wherein the pulse is one of an electron pulse and an ion pulse.

According to another embodiment, a glow discharge lamp system is provided comprising: a glow discharge lamp for ionizing a sample of a material to be analyzed in a plasma; an RF power supply for supplying RF power to the glow discharge lamp at a power level selected in response to an RF output control signal; a lamp current sensor for sensing a total lamp current and generating a total lamp current signal representative of the total lamp current over time; and a processor for receiving the total lamp current signal from the lamp current sensor and for supplying the RF output control signal to the RF power supply, wherein the processor determines an integrated pulse area of a pulse contained within the total lamp current signal and adjusts the RF power supplied to the glow discharge lamp in response to the integrated pulse area, wherein the pulse is one of an electron pulse and an ion pulse.

According to another embodiment, a method for controlling plasma conditions of a glow discharge lamp is provided that comprises: measuring a total lamp current of the glow discharge lamp; determining an integrated pulse area contained within the total lamp current using a processor; measuring an effective plasma power of the glow discharge lamp; and adjusting a pressure of the glow discharge lamp as to alter at least one of the effective plasma power and the integrated pulse area, wherein the integrated pulse area is one of an integrated electron pulse area and an integrated ion pulse area.

According to another embodiment, a method is provided of calibrating an integrated pulse area of a glow discharge lamp to a quotient of effective plasma power divided by effective voltage, wherein the integrated pulse area is one of an integrated electron pulse area and an integrated ion pulse area. The method comprises: measuring effective plasma power, integrated pulse area, and effective voltage on a conductive sample at no fewer than one plasma operating point; controlling at least one plasma operating point by varying at least one of a pressure of the glow discharge lamp and the effective plasma power; using the quotient of effective plasma power divided by effective voltage to determine effective plasma current using a processor in communication with the glow discharge lamp; and using the processor to create a mathematical function or table relating the integrated pulse area to the effective plasma current and storing the mathematical function or table in a memory device.

According to another embodiment, a method is provided of calibrating an integrated pulse area of a glow discharge lamp to an effective plasma current, wherein the integrated pulse area is one of an integrated electron pulse area and an integrated ion pulse area. The method comprises: measuring effective plasma power, integrated pulse area, and effective voltage on a conductive sample at no fewer than one plasma operating point; controlling at least one plasma operating point by varying at least one of a pressure of the glow discharge lamp and the effective plasma power; using a quotient of effective plasma power divided by effective voltage to determine effective plasma current using a processor in communication with the glow discharge lamp; and using the processor to create a mathematical function or table relating the integrated pulse area to the effective plasma current and storing the mathematical function or table in a memory device.

According to another embodiment, a method is provided for determining an integrated pulse area of a pulse contained within a total lamp current signal of a glow discharge lamp, wherein the pulse is one of an electron pulse and an ion pulse, the method comprising: continuously calculating a sum of the total lamp current signal using a processor in communication with the glow discharge lamp; determining a start time of the pulse; determining an end time of the pulse; and determining the integrated pulse area using the processor by subtracting a value of the sum found at the start time of the pulse from a value of the sum found at the end time of the pulse.

These and other features, advantages, and objects of the present invention will be further understood and appreciated by those skilled in the art by reference to the following specification, claims, and appended drawings.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention. In the drawings.

Figure 1:
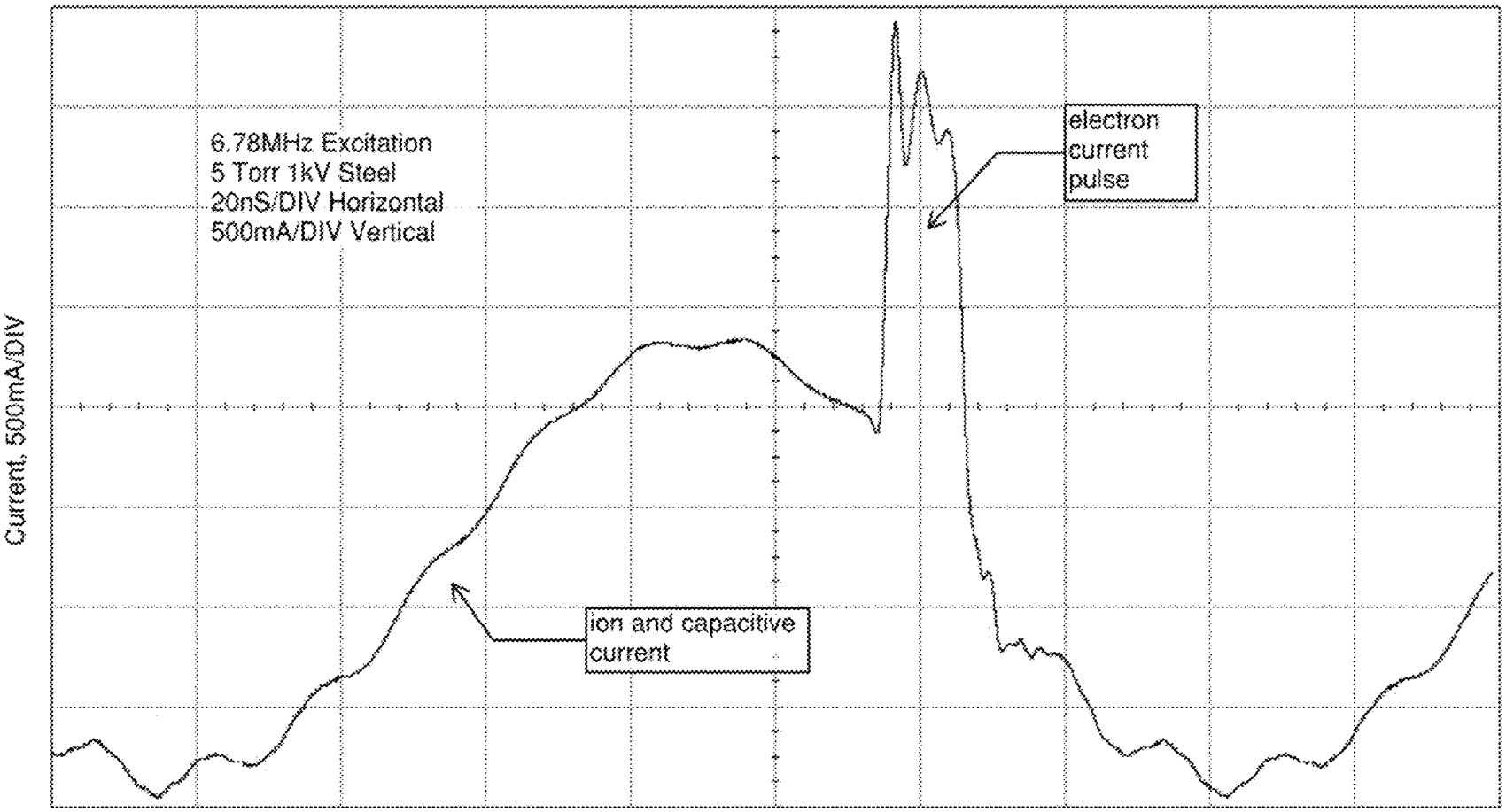
FIG. 1 is an oscilloscope trace of a total lamp current measurement.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF THE PREFERRED EMBODIMENTS

Before describing in detail the embodiments that are in accordance with the present invention, it should be observed that the embodiments reside primarily in combinations of method steps and apparatus components related to a transformer using an internal load. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof are intended to cover a non-exclusive inclusion, such that a process, method, article, or apparatus that comprises a list of elements does not include only those elements, but may include other elements not expressly listed or inherent to such process, method, article, or apparatus. An element proceeded by "comprises . . . a" does not, without more constraints, preclude the existence of additional identical elements in the process, method, article, or apparatus that comprises the element.

This embodiment of the invention is based on the discovery that the integrated area of the electron pulse within the total lamp current or the integrated electron pulse area is directly proportional to the effective plasma current. Further, this embodiment realizes that the relationship between integrated electron pulse area and the effective lamp current follows a first order equation and therefore can be used to provide one of the two electrical parameters for control or measurement of the discharge. Since the second required electrical parameter of effective power can be measured using already known methods, this embodiment is important to the application of sputter rate control and quantitative or compositional spectroscopic analysis. Although the methods herein discussed center around the measurement of the integrated electron pulse area, those skilled in the art will realize that the same result could be realized by measuring or integrating the ion current area.

FIG. 1 shows the total lamp current as measured using the technique outlined in Ludger Wilken, Volker Hoffmann, Peter Geisler, and Klaus Wetzig (2004, Nov. 23), U.S. Pat. No. 6,822,229, the entire disclosure of which is incorporated herein by reference. The electron pulse is distinguished by its fast rise and fall times as compared to the fundamental excitation frequency of 6.78 MHz. Other harmonic content is also present in the total lamp current measurement. These mostly sinusoidal currents are created by resonances of electronic components used in the generation of the RF excitation voltage or the interaction between the components used.

Figure 2:
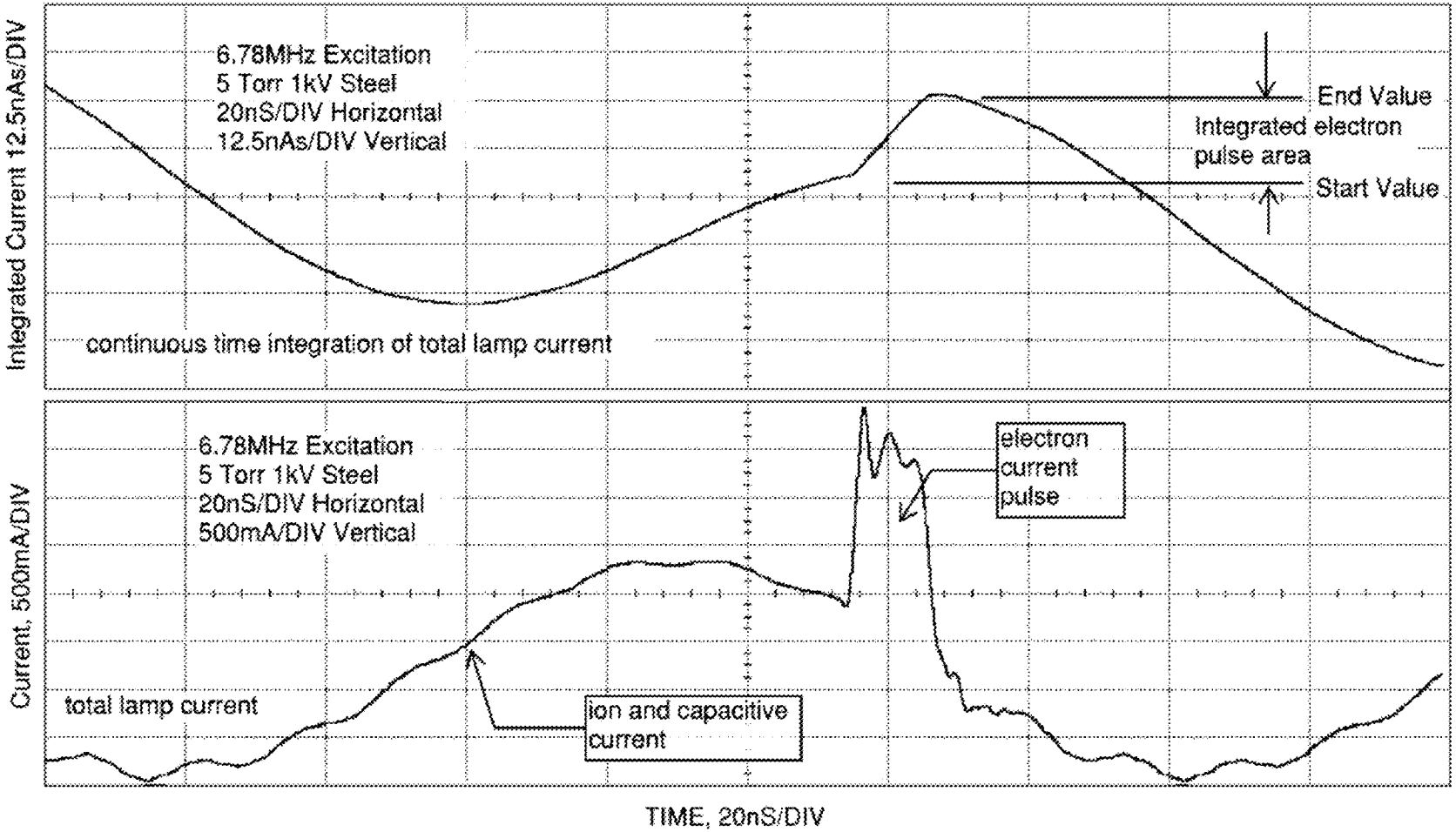
FIG. 2 is an oscilloscope trace showing the integration of the electron current pulse.

FIG. 2 illustrates a method for integration of the electron pulse to find the integrated electron pulse area. Using continuous time integration of the total lamp current, which is the continuous summation of the total lamp current values, the electron current pulse area can be determined. This method has the advantage of filtering out the effects of the harmonics created by the electronic resonances as described above. The slope or first derivative of the total lamp current signal or the continuous time summation can be used to identify the time for measurement of a start value. Using this method, the start time is determined whenever the first derivative or slope of the total lamp current or the continuous summation of the total lamp current exceeds a predetermined value. As an alternative, the abrupt change in slope or first derivative created at the beginning or start of the electron current pulse can be used to identify the time for measurement of a start value. For example, the start value measurement time could be triggered whenever the second derivative of either the actual total lamp current or the continuous integrated lamp current is greater than a predefined level. The end value measurement time can determined at the point the continuous integration value slope or first derivative reaches zero. By subtracting the values measured at the start and end times, the total integrated electron pulse area can be determined. Other methods of determining the integrated electron pulse area could be used including, but not limited to, digital sampling, box car integration, sample and hold circuits, and electronic or digital filters.

Figure 3:
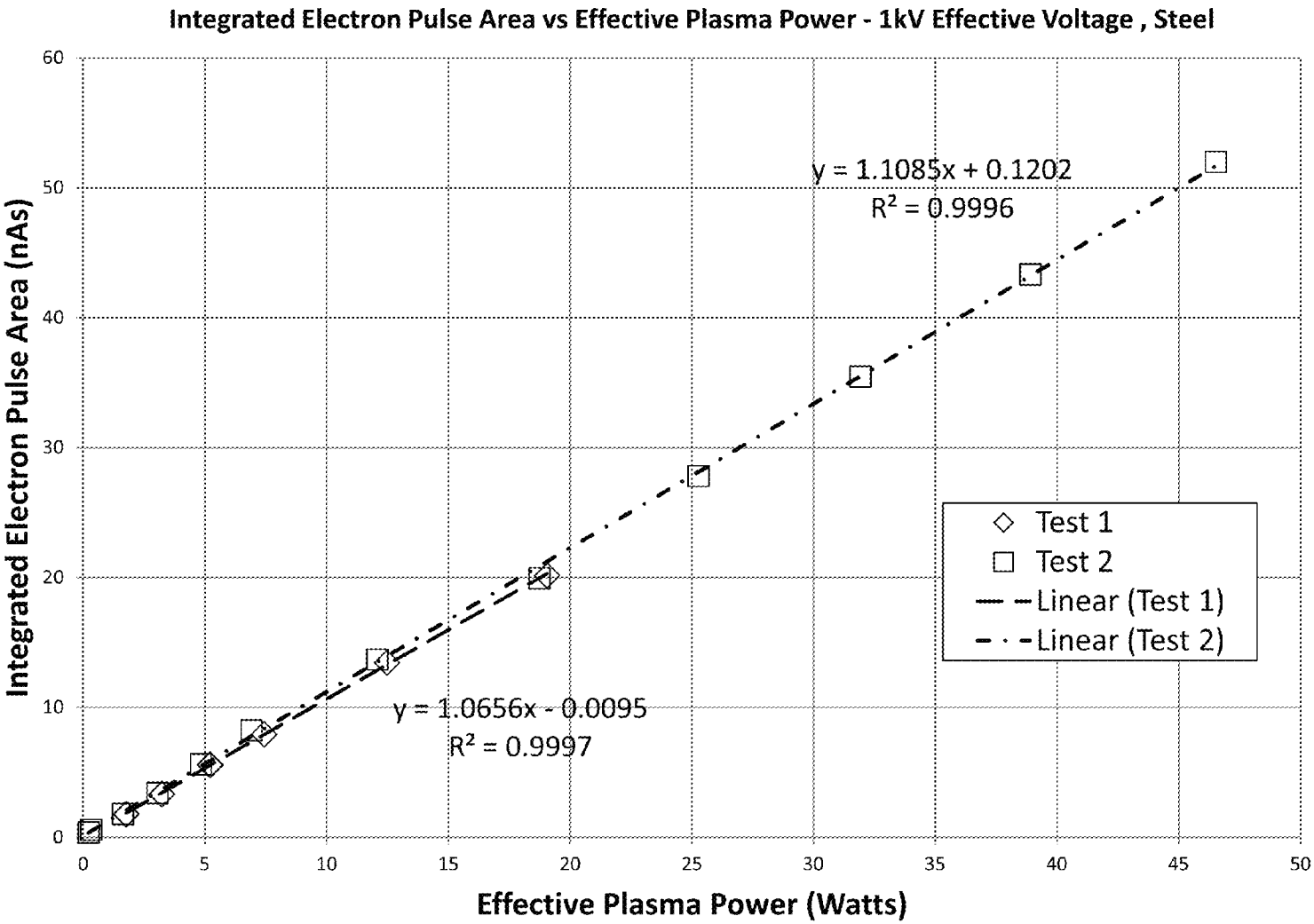
FIG. 3 is a graph showing the linear relationship of integrated electron current and effective plasma power with effective lamp voltage held constant.

FIG. 3 shows the linear relationship between the integrated electron pulse area and the effective plasma power when effective lamp voltage is held constant. The data represents typical values obtained with the effective lamp voltage held at 1 kV sputtering a steel sample. To obtain the data, the lamp pressure was varied to achieve a different plasma impedance or effective voltage to effective current ratio. At each lamp pressure, effective plasma power was calculated using the methods described by K. A. Marshall, T. J. Casper, K. R. Brushwyler, and J. C. Mitchell (2003) in "The analytical impact of power control in a radio frequency glow discharge optical emission plasma," *J. Anal. At. Spectrom* 18, pp. 637-645, the entire disclosure of which is incorporated herein by reference. Test 1 shows data collected during one experiment while Test 2 represents data collected at a later time. The relationship between the integrated electron pulse area and the effective plasma power is first order with very good repeatability. This first order relationship illustrates that integrated electron pulse area is representative of the effective lamp current as the quotient of effective power divided by effective voltage yields effective current. Since effective voltage was held constant, the ratio of effective power to effective current is a fixed value or a first order equation.

Figure 4:
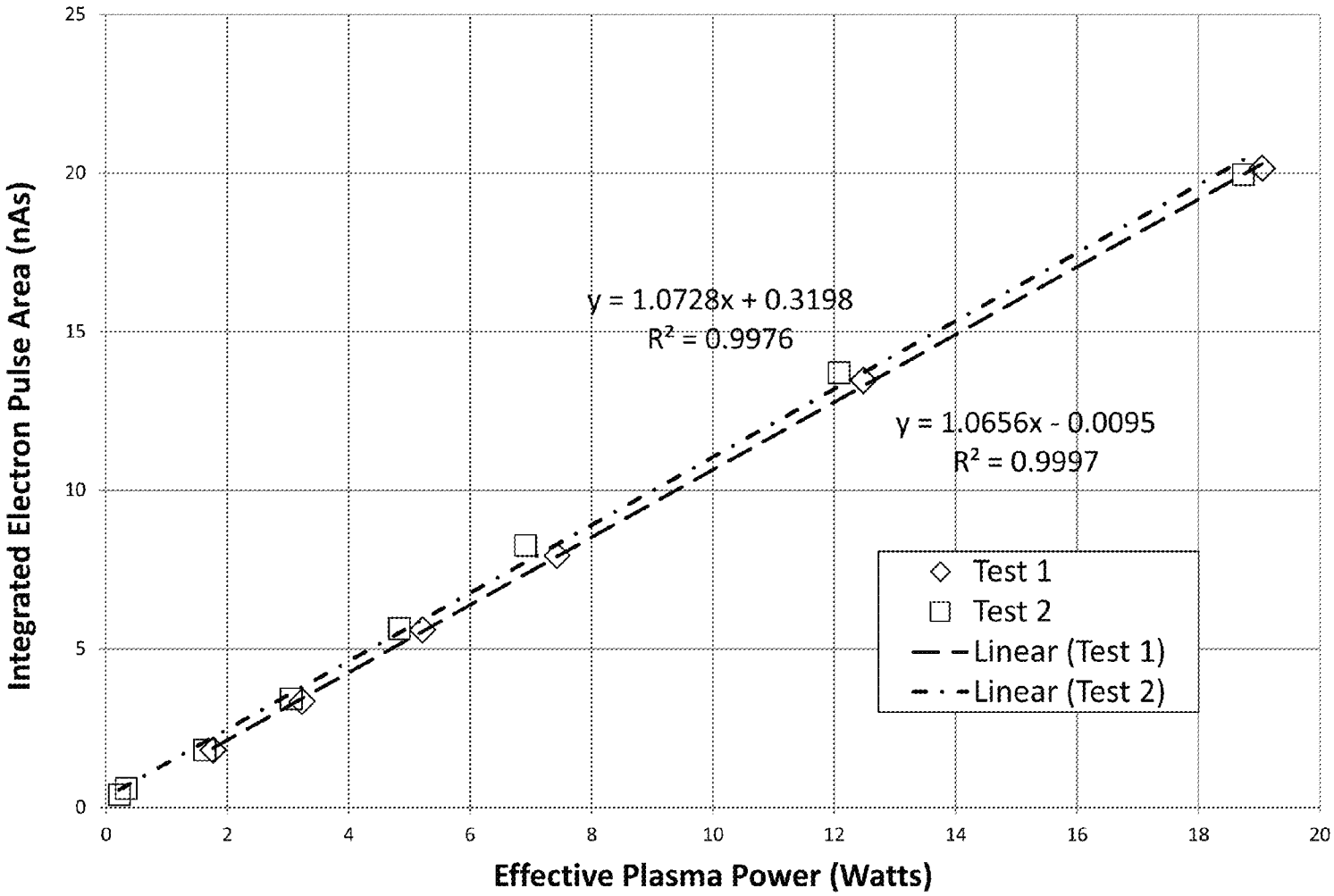
FIG. 4 is a graph showing the linear relationship of integrated electron current and effective plasma power with effective lamp voltage held constant for effective powers less than 20 Watts.

FIG. 4 shows the data illustrated in FIG. 3 but confined to a low power range of 20 Watts effective plasma power. Power levels less than 20 Watts are typical of levels used in analysis of thin layers or low temperature materials. In order to achieve accurate control of the plasma, the parameters measured must provide sufficient accuracy in the actual operating range. Using the same trend lines determined in FIG. 3, the repeatability at 10 nAs is within 6%. If the trend lines are limited to effective powers less than 20 Watts, the repeatability is better than 5% of effective power.

Figure 5:
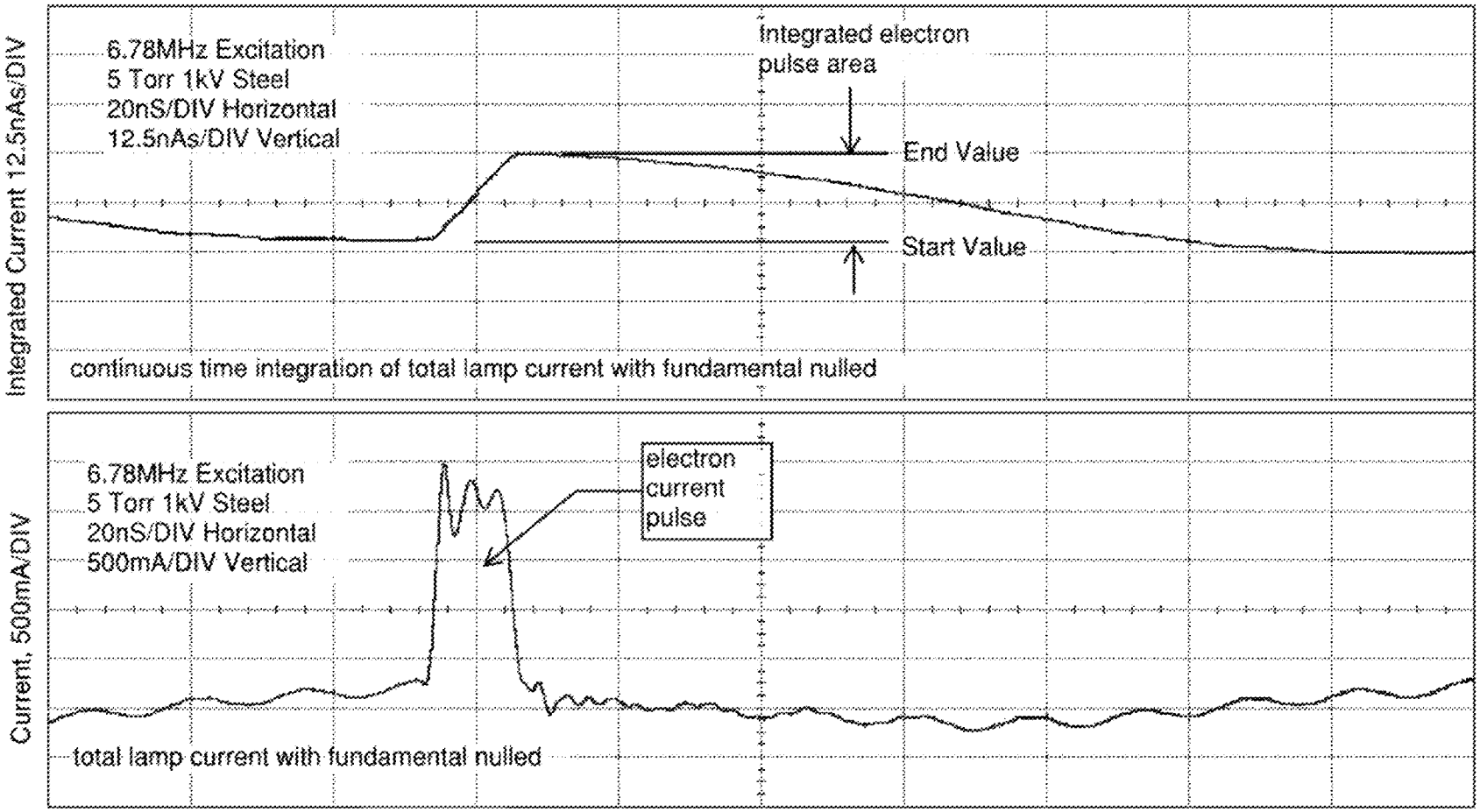
FIG. 5 illustrates the effect of removing the fundamental frequency of the plasma current.

An integrated electron pulse area can also be measured with the fundamental drive frequency filtered or nulled from the total lamp current. The nulling can remove or minimize fundamental drive frequency capacitive current contribution from the total lamp current measurement. Removal or reduction of the fundamental drive frequency current from the total lamp current measurement increases the ability to differentiate or identify the electron pulse from the total lamp current. The removal of the fundamental frequency component can be accomplished electronically by summing in a phase shifted amount of the RF drive voltage with the total lamp current or digitally through the use of digital filtering of the total lamp current. Other electronic methods of nulling or minimizing the fundamental current are also possible. FIG. 5 illustrates the effect that nulling the fundamental frequency has on the total lamp current and the continuous integrated signal. The electron current pulse height when compared to the total peak-to-peak range of the total lamp current is enhanced with the fundamental frequency nulled. Looking at the total lamp current with a fundamental nulled trace of FIG. 5, the total electron current pulse height is approximately 4.5 divisions or 82% of the total peak-to-peak swing of 5.5 divisions. FIG. 2 shows the electron current pulse height at approximately 4 divisions or 50% of the peak-to-peak swing of the total lamp current of 8 divisions. With the fundamental currents nulled from the total lamp current, total integrated area of the electron pulse is not appreciably affected.

Figure 6:
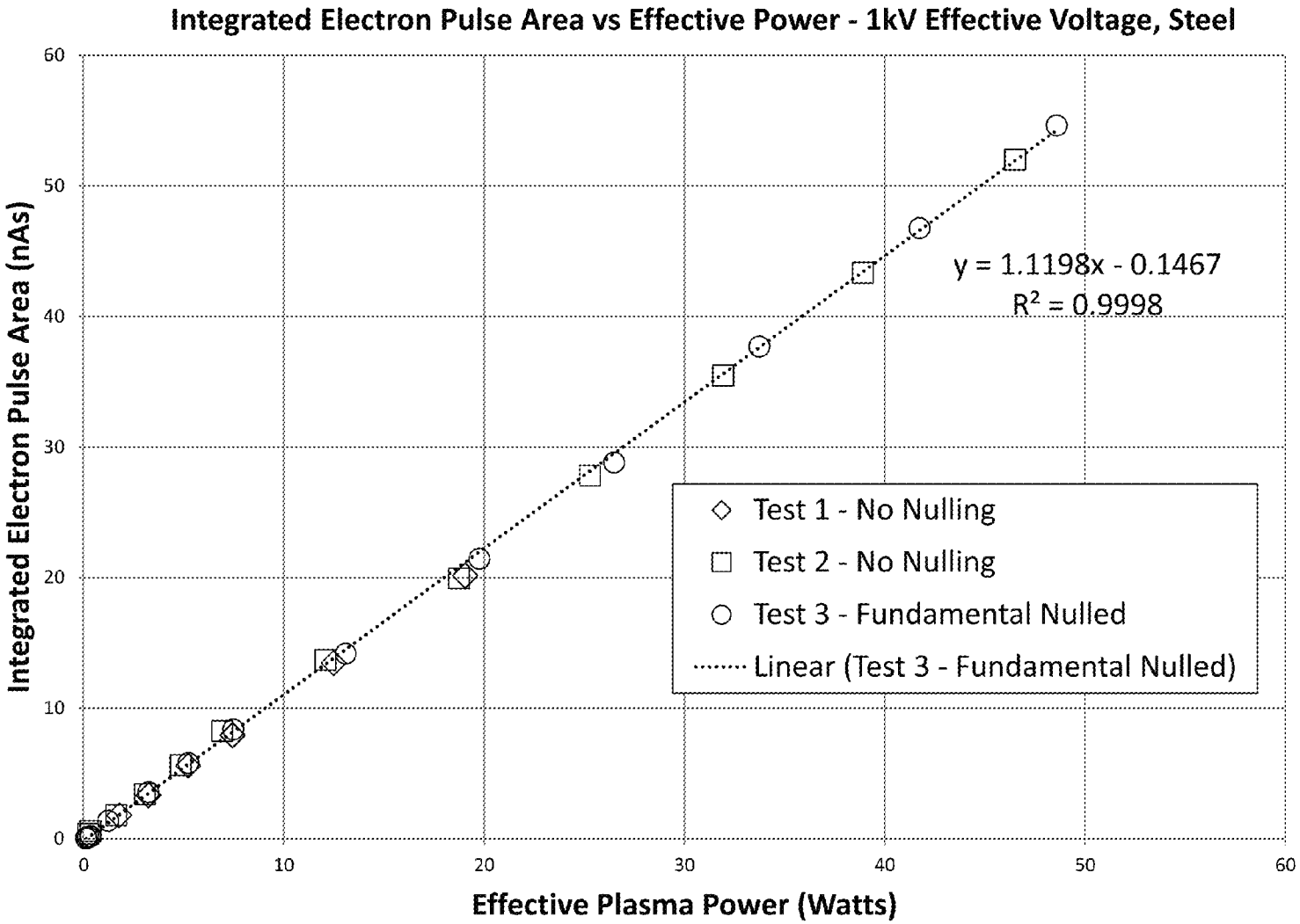
FIG. 6 is a graph showing the linear relationship of integrated electron current and effective plasma power with effective lamp voltage held constant with and without fundamental frequency nulling.

FIG. 6 adds integrated electron pulse area data recorded with the fundamental currents nulled to that of FIG. 3. The data in FIG. 6 was collected on steel with an effective lamp voltage of 1 kV. The trend line for the nulled fundamental measurements is nearly the same as those collected without nulling of the fundamental signal. To obtain this data, the lamp pressure was varied to achieve a different plasma impedance or effective voltage to effective current ratio. At each lamp pressure, effective plasma power was calculated using the methods described by K. A. Marshall, T. J. Casper, K. R. Brushwyler, and J. C. Mitchell (2003) in "The analytical impact of power control in a radio frequency glow discharge optical emission plasma," *J. Anal. At. Spectrom* 18, pp. 637-645, the entire disclosure of which is incorporated herein by reference.

Figure 7:
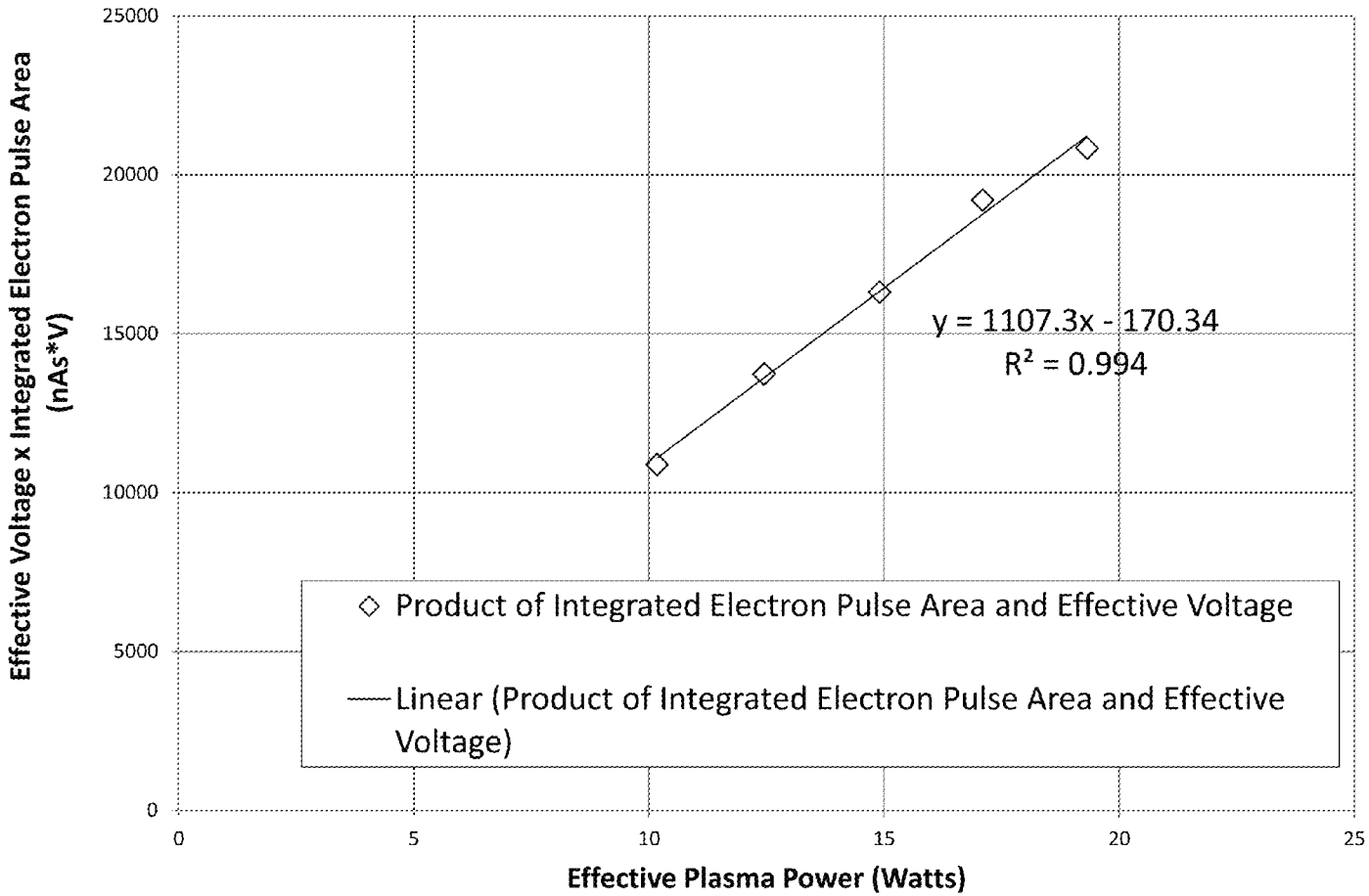
FIG. 7 is a graph showing the linear relationship between the product of effective lamp voltage and integrated electron pulse area with the effective plasma power.

FIG. 7 illustrates that the relationship between integrated electron pulse area, effective voltage, and effective power is linear over different operating voltages. The lamp pressure was held constant at 5 Torr while the lamp effective voltage was varied. At each effective voltage, effective plasma power was calculated and the integrated electron pulse area was determined. Lamp voltages varied between 600V and 1 kV effective.

Utilization of the integrated electron current in a glow discharge system can require calibration of the electron pulse area with a known quantity. One method of obtaining this calibration would be to run a conductive sample at two effective voltages holding pressure at a known value. At each voltage V1, V2 record the effective plasma powers P1, P2 and the integrated electron pulse areas A1, A2. From the quotient of the effective plasma power divided by effective voltage, a processor can calculate the effective lamp current I1=P1/V1 and I2=P2/V2. The calibration will have the form of $y=mx+b$ where y is the effective lamp current, x is the integrated electron pulse area, m is the gain or slope relating y to x, and b is the offset or y intercept of the relationship. To determine m, take the quotient of the difference between I2 and I1 divided by the difference between A2 and A1 or in equation form m=(I2−I1)/(A2−A1). The intercept is found by substituting I1,A1 or I2,A2 into the original equation using m as calculated above. Therefore, b=I1−(m)A1 or b=I2−(m)A2. More than two sets of data points could be used to further improve the accuracy of the calibration.

A second method of calibrating the integrated electron pulse area would be to sputter a conductive sample, hold the effective lamp voltage constant and vary the lamp pressure. At each pressure PR1, PR2 record effective lamp voltages V1, V2, effective plasma powers P1, P2 and the integrated electron pulse areas A1, A2. The process of determining the calibration equation is the same as outlined in the previous method.

A third method of calibrating the integrated electron pulse area would be to sputter a conductive sample, hold the effective lamp power constant and vary the lamp pressure. At each pressure PR1, PR2 record effective lamp voltages V1, V2, effective plasma powers P1, P2 and the integrated electron pulse areas A1, A2. The process of determining the calibration equation is the same as outlined in the previous method.

Other combinations of effective plasma power, effective voltage and pressure could also be utilized to perform the calibration. The only requirement of calibration that includes the intercept value is that at least two sets of data are collected, each having different values of effective power or effective voltage.

Figure 8:
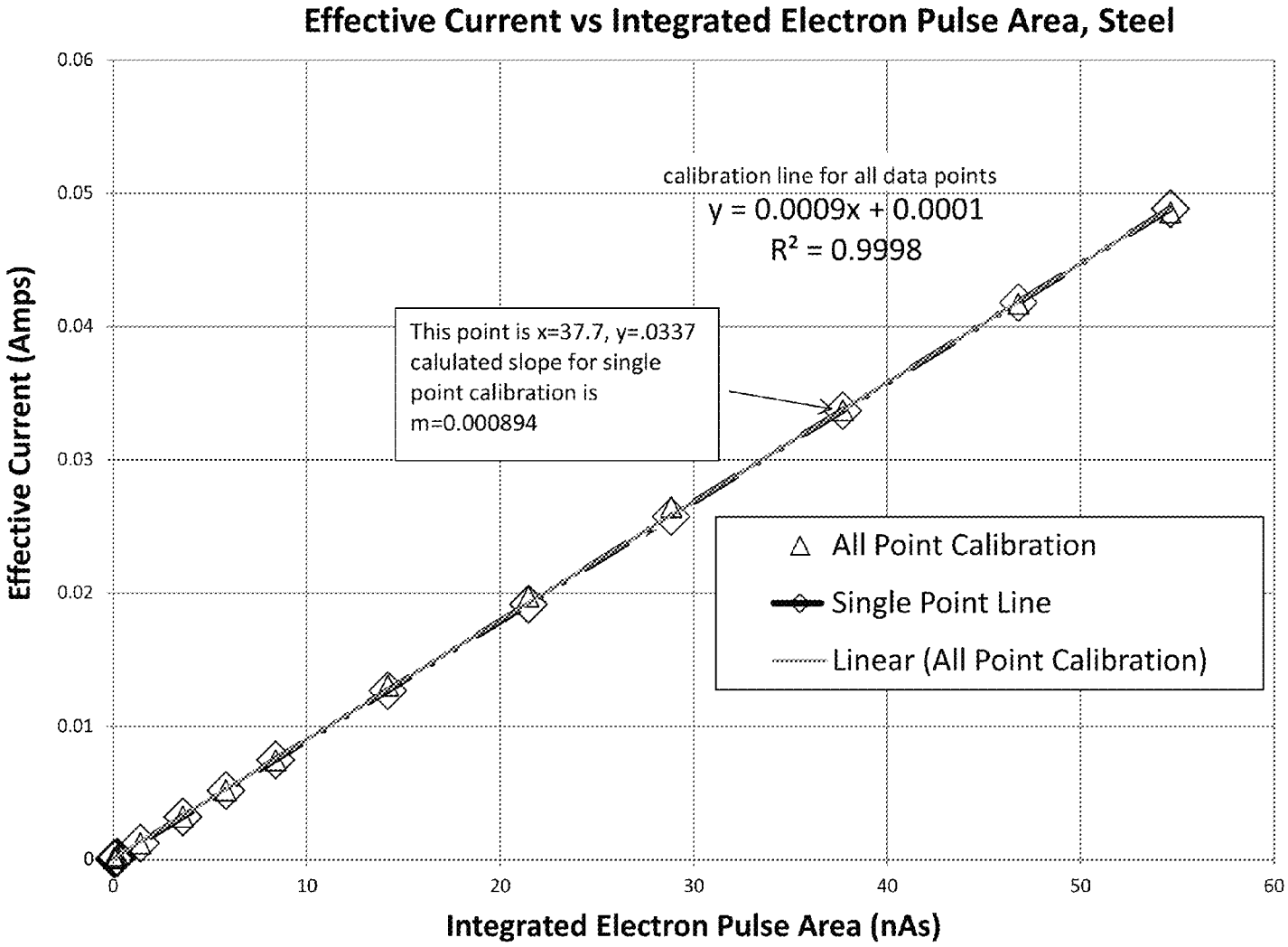
FIG. 8 shows the calibration values obtained using a multipoint method and a single point method on a steel sample.

A single point method for calibrating the measured integrated electron pulse area to effective lamp current would include any of the methods discussed previously, but only requires one set of measurements. This method does not give an offset or y intercept, but can be used with comparable results. To calculate the slope, simply take the quotient of I1 divided by A1 or m=I1/A1. In this case b is zero. FIG. 8 shows the calibration values obtained using a multipoint method and a single point method on a steel sample. The single point method achieves nearly identical results.

The calibration equation relating an integrated electron pulse area to effective lamp current is only necessary to correlate measurements back to well-known DC sputter rates and emission tables. Even if this correlation is not required, the use of obtaining the integrated electron pulse area is still useful for control of the plasma and sputter rates. In cases where samples are comprised of insulating layers or consist of insulating material only, the measurement of integrated electron pulse area can be utilized to replace the measurement of effective lamp voltage. This will allow the control of plasma conditions for thin, nonconductive layers or complete insulating structures by allowing lamp pressure to be adjusted to obtain a desired effective plasma power and integrated electron pulse area ratio. The use of an integrated electron pulse area overcomes the limitations of estimating the effective plasma voltages used in previous methods of plasma control or correction. An integrated electron pulse area can also be used to adjust the level of RF power applied to the lamp in order to obtain a desired effective plasma current level.

A method for controlling the plasma conditions of a glow discharge system involves monitoring the effective plasma power, monitoring the integrated electron pulse area, and adjusting the lamp pressure to obtain the desired effective power as well as the desired ratio of effective power and integrated electron pulse area. The control of plasma parameters using the integrated electron pulse area along with effective power allows for repeatable results in samples that cannot be precisely controlled using effective power and effective voltage, such as nonconductors or insulating layers.

Figure 9:
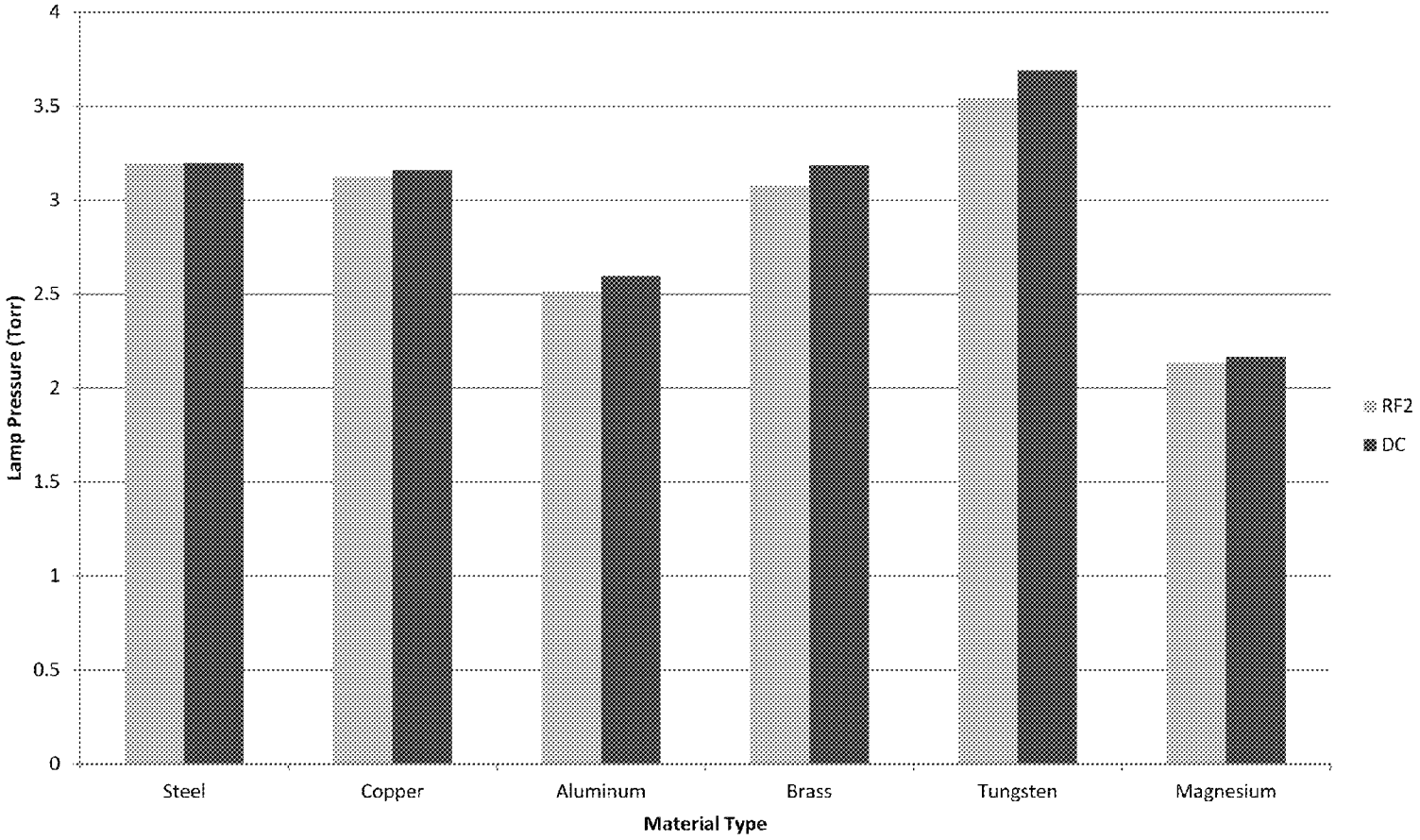
FIG. 9 compares the results of using integrated electron pulse area and effective power on an RF glow discharge lamp to those obtained using a DC power supply.

FIG. 9 compares the results of using an integrated electron pulse area and effective power for controlling a RF glow discharge lamp to those obtained using a DC power supply. A number of different materials were sputtered on the glow discharge lamp using a DC power supply. Each sample was run at 1 kV with the lamp pressure adjusted to obtain 7.4 mA of plasma current or 7.4 Watts plasma power. The lamp pressure that resulted in obtaining the 1 kV, 7.4 mA ratio was recorded. The same glow discharge lamp was then connected to an RF power supply, and the RF power and pressure were adjusted iteratively to obtain an effective plasma power of 7.4 Watts with an integrated electron pulse area that corresponded with 7.4 mA effective plasma current. The pressure used to obtain the 7.4 Watt, 7.4 mA ratio was recorded. The pressure obtained in DC and RF conditions is nearly identical and follows the same trend in regards to material type and pressure amplitude signifying that using an integrated electron pulse area to control plasma conditions is valid in the control of sputter rates.

Figure 10:
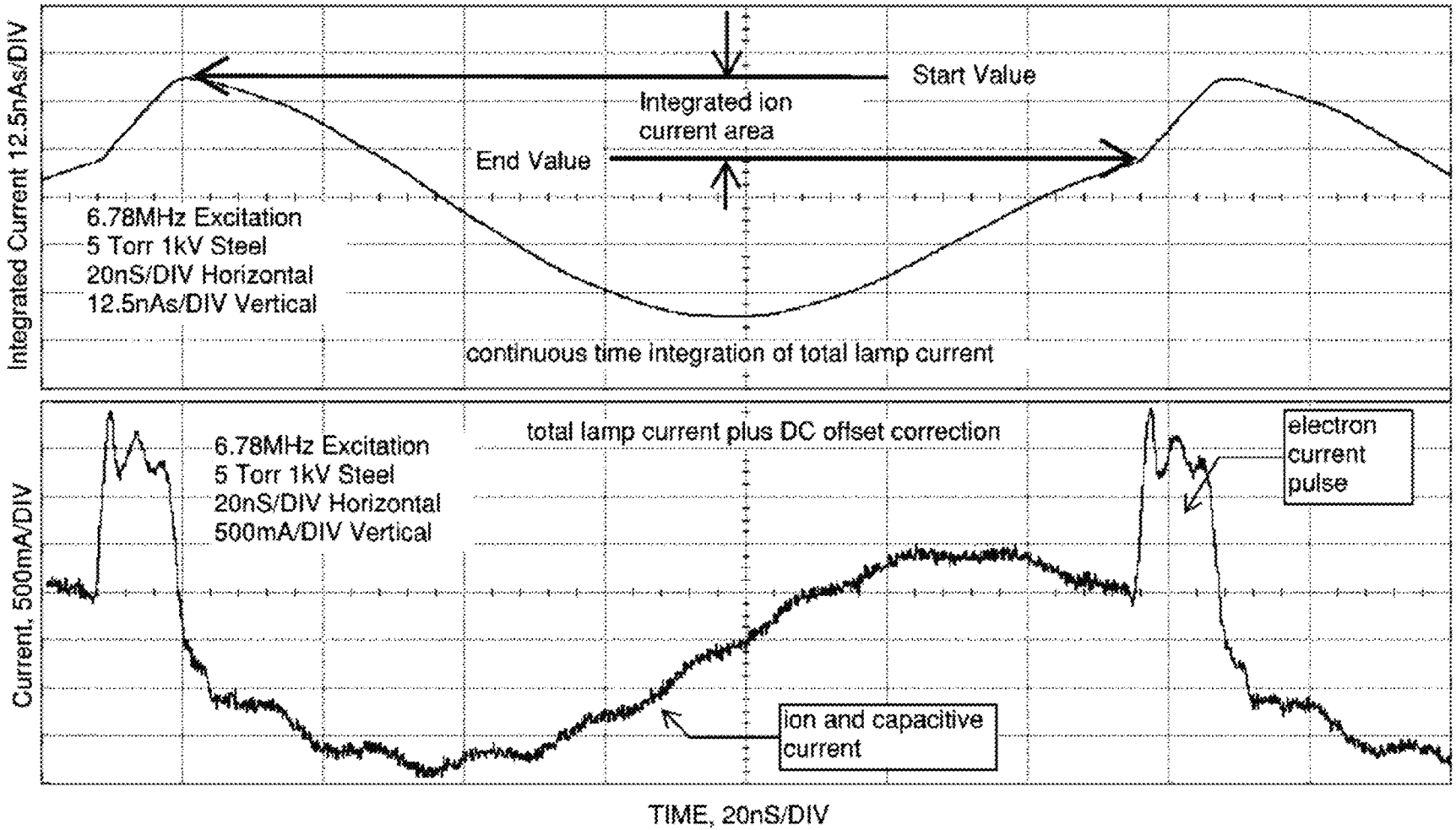
FIG. 10 is an oscilloscope trace showing the integration of the ion current area with capacitive currents present.

An alternative method for determining the effective lamp current using integrated ion current area is illustrated in FIG. 10. Due to the length of integration time between start and stop points used to measure ion current area compared to that used to measure electron pulse area, removal of any DC offsets from the total lamp current signal is preferred for obtaining accurate results. Without DC offset removal, the continuous time integrated signal will drift in a positive or negative direction depending on the polarity of the DC offset. The effect of DC offset removal can best be seen by observing values in adjacent cycles of the continuous time integrated signal. The total lamp current shown in FIG. 10 has had its DC offset compensated by summing in a DC value resulting in a repeatable amplitude in the continuous time integrated signal. The total lamp current shown in FIG. 2 did not have DC compensation applied resulting in a slow negative drift of the continuous time integrated signal between adjacent cycles. DC removal or compensation of the total lamp current can also be used when determining effective lamp current by electron pulse area to improve accuracy. Other methods of DC removal could include, but are not limited to, digital sampling, box car integration, sample and hold circuits, and electronic or digital filters.

Using continuous time integration of the total lamp current with DC offset correction, the integrated ion current area can be determined as shown in FIG. 10. The start value measurement time can be determined at the point where the value of the continuous time integration slope or first derivative reaches zero after the previous slope value has been positive. FIG. 10 has three points where the slope of the continuous time integrated signal approaches zero. To better define the start value measurement time, additional qualifiers can be added. If needed, a second qualifier could be added when determining the start point by requiring the slope of the continuous time integrated signal to have reached or exceeded a predetermined value before the zero slope point was found. The slope or first derivative of the total lamp current signal or the continuous time summation can be used to identify the time for measurement of an end value. Using this method, the end time is determined whenever the first derivative or slope of the total lamp current or the continuous summation of the total lamp current exceeds a predetermined value. As an alternative, the abrupt change in slope or first derivative created at the beginning or start of the electron current pulse can be used to identify the time for measurement of an end value. For example, the end value measurement time could be triggered whenever the second derivative of either the actual total lamp current or the continuous integrated lamp current is greater than a predefined level. By subtracting the values measured at the start and end times, the integrated ion current area can be determined. Other methods of determining the integrated ion current area could be used including, but not limited to, digital sampling, box car integration, sample and hold circuits, and electronic or digital filters.

Figure 11:
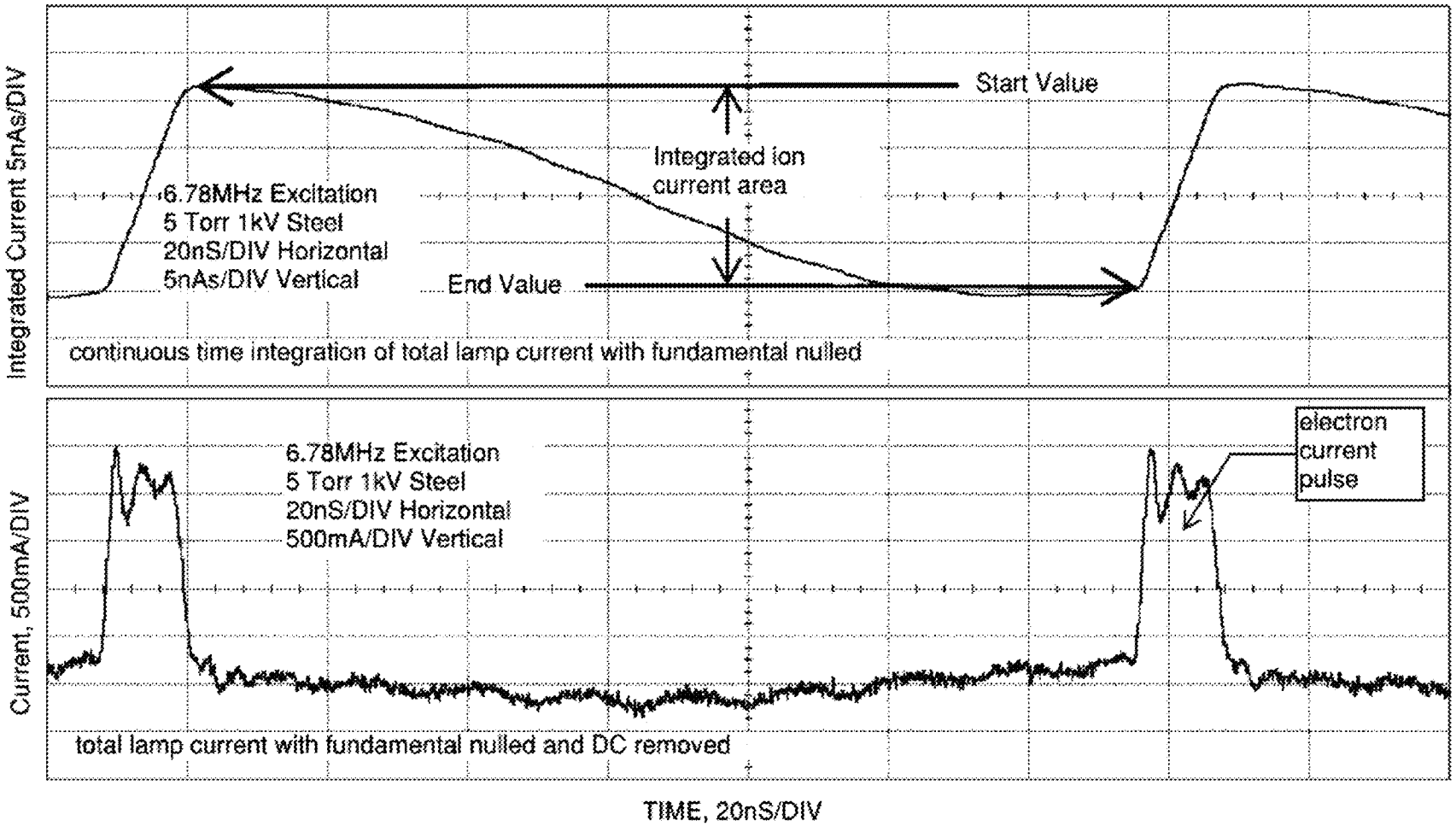
FIG. 11 is an oscilloscope trace showing the integration of the ion current area with fundamental frequency capacitive currents removed.

FIG. 11 illustrates an alternative method for the measurement of integrated ion current area to determine effective lamp current. In FIG. 11, the total lamp current has had the fundamental frequency filtered or nulled and DC offset removed as described previously. The advantages described for measurement of integrated electron current pulse area with the fundamental nulled also apply to the measurement of the integrated ion current area.

The application and calibration methods used to correlate integrated electron pulse area to effective lamp current can be used with integrated ion current area.

Figure 12:
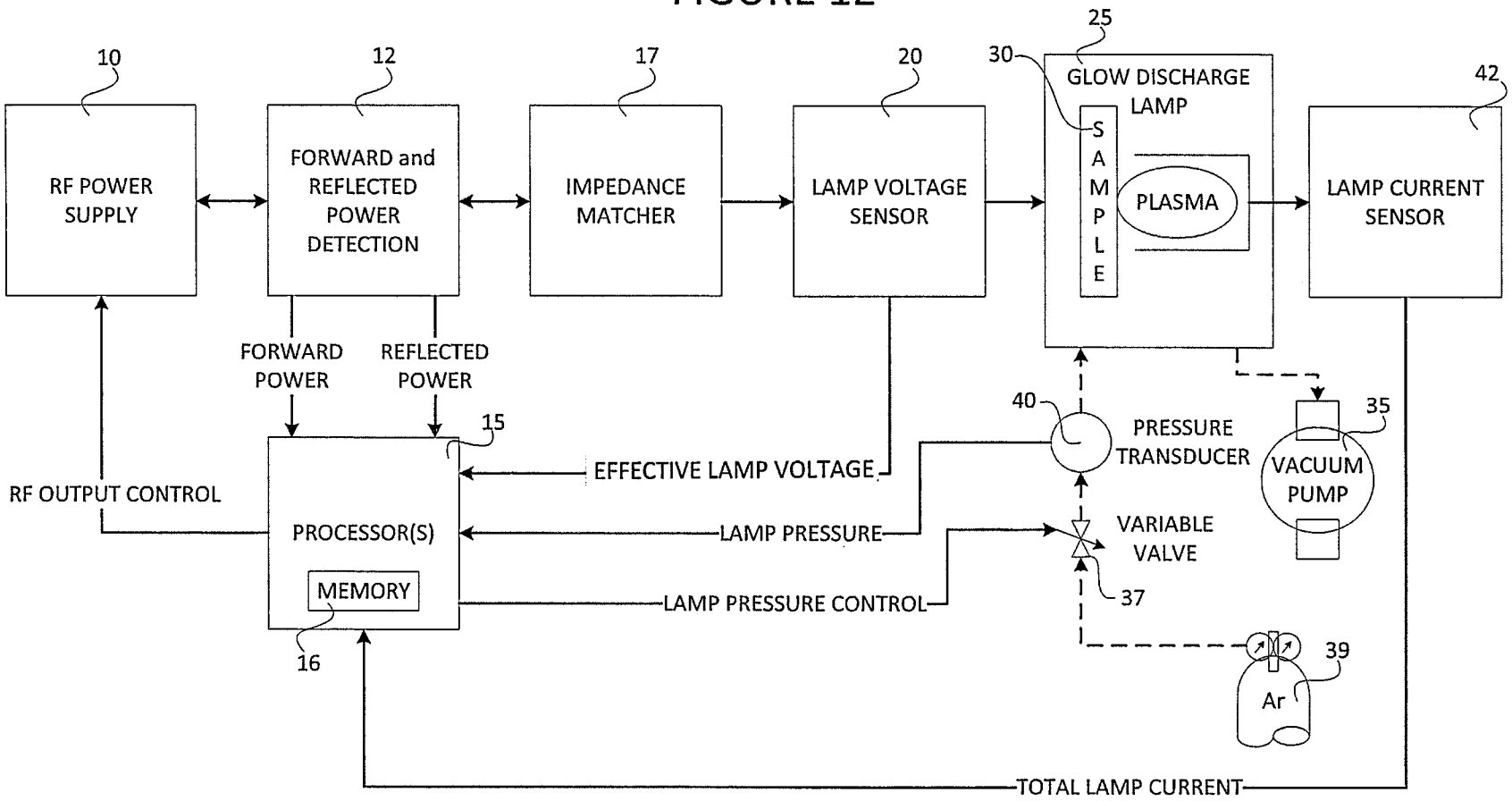
FIG. 12 is an electrical circuit diagram in block form of a glow discharge lamp system according to an embodiment of the present invention.

FIG. 12 illustrates one embodiment of a glow discharge system utilizing effective lamp current for control of the glow discharge lamp plasma conditions. An RF power supply 10 creates a variable output power signal that is passed through a forward and reflected power detection circuit 12. The output power level of RF power supply 10 is controlled by a processor 15 using an RF output control signal.

Forward and reflected power detection circuit 12 samples power flowing from and back into RF power supply 10. The sample of RF power flowing from RF power supply 10 towards an impedance matcher 17 is called forward power. The forward power signal is monitored by processor 15. Forward and reflected power detection circuit 12 also samples the power reflected off impedance matcher 17, which returns to RF power supply 10. The sample of power returned back to RF power supply 10 is called reflected power. The reflected power signal is monitored by processor 15.

Impedance matcher 17 transforms the RF power supplied by RF power supply 10 from a typical 50 Ohm impedance level to an impedance that most efficiently transfers power into the glow discharge lamp structure. Impedance matcher 17 is typically controlled by a processor (connection not shown), which may or may not be the same processor 15 used to control glow discharge lamp 25.

A measurement of the RF voltage applied to the sample and lamp structure is taken by a lamp voltage sensor 20. The measurement of the sample and lamp voltage is called "effective lamp voltage." The effective lamp voltage signal is monitored by processor 15. As detailed previously, effective lamp voltage is equal to effective voltage only when the sample is conductive.

A glow discharge lamp 25 is connected to impedance matcher 17 and contains or holds a sample 30 of material to be analyzed. An example of a suitable glow discharge lamp can be found in U.S. Pat. No. 5,408,315, the entire disclosure of which is incorporated herein by reference. A vacuum pump 35 is connected to glow discharge lamp 25 to provide the proper level of pressure required for glow discharge plasma formation. A variable valve 37 is connected to glow discharge lamp 25 to provide Argon or other suitable gas from a storage tank 39 to the lamp assembly in a controlled fashion. Variable valve 37 is typically controlled by processor 15. A pressure transducer 40 is typically installed to measure the glow discharge lamp pressure. The pressure transducer output is called "lamp pressure" and is monitored by processor 15.

A lamp current sensor 42 is attached or embedded to the glow discharge lamp. An example of the manner by which a lamp current sensor may be attached to a glow discharge lamp is described by Ludger Wilken, Volker Hoffmann, Peter Geisler, and Klaus Wetzig (2004, Nov. 23) in U.S. Pat. No. 6,822,229, the entire disclosure of which is incorporated herein by reference. The output of lamp current sensor 42 is a signal called "total lamp current." The signal total lamp current is applied to processor 15.

Processor 15 may include analog and/or digital signal processing circuitry, analog to digital converters, digital to analog converters along with various computational devices such as digital signal processors (DSP), central processing units (CPU) or other types of programmable and computational logic. Processor 15 may include internal memory 16 and/or be coupled to external memory. The function of processor 15 is to convert the various signal inputs into digital form, compute True Plasma Power™ (TPP) also known as "effective power" (EP) as described below, compute the effective lamp current using one of the previously described methods, then adjust the lamp pressure control and RF output control as to control the plasma characteristics to a desired value thereby controlling the sputter rate of the sample.

True Plasma Power™ (TPP) or Effective Power (EP) calculates the power being utilized for plasma formation by subtracting system losses from the RF power generated in RF power supply 10 in a dynamic fashion. The system losses include heat generation in impedance matcher 17 and lamp circuitry including dielectrics and conductors, energy reflected from impedance matcher 17 back to the RF power supply 10 due to impedance mismatch, and RF losses in the system interconnect and monitor circuits such as forward and reflected power detection circuits 12 and lamp voltage sensor 20.

As explained in K. A. Marshall, T. J. Casper, K. R. Brushwyler, and J. C. Mitchell (2003), "The analytical impact of power control in a radio frequency glow discharge optical emission plasma," *J. Anal. At. Spectrom* 18, pp. 637-645, the entire disclosure of which is incorporated herein by reference, losses in an impedance matcher and lamp circuitry, including a lamp voltage sensor, can be compensated for by first measuring the amount of RF power that is required to generate a given value of RF voltage at the lamp voltage sensor with the sample in place and the lamp deprived of gas necessary to create a plasma. This is commonly referred to as "blind power measurement" as there is no plasma or light created due to lack of gas.

One method to accomplish the blind power measurement would be to have processor 15 close off variable valve 37. Processor 15 would then apply RF power to the system from the RF power supply 10 by adjusting the value of the RF output control line for a desired level of RF power as measured by forward and reflected power detection circuit 12. Processor 15 would then adjust impedance matcher 17 to minimize reflections thereby maximizing power coupling to glow discharge lamp 25 by measurement of forward and reflected power detection circuits 12. The adjustment of impedance matcher 17 could also be accomplished through the use of analog circuitry such as phase and magnitude detection. Once the proper adjustment of impedance matcher 17 is reached, no further adjustments to impedance matcher 17 are made unless another blind power measurement is required. Processor 15 also monitors the effective lamp voltage signal and could adjust the RF output control signal to obtain a desired effective lamp voltage level at lamp voltage sensor 20.

The values for blind forward power (BFP), blind reflected power (BRP), and blind effective lamp voltage (BV) obtained during the blind power measurement are typically stored in memory 16 of processor 15 or an external memory or computing device not shown. Power Loss (PL) at a given effective lamp voltage has been shown to be related to the equation as long as tuning is not altered:

$$PL=(BFP-BRP)(Veff/BF)\hat{}2.$$

where Veff is the value of effective lamp voltage measured at a given time. The equation for Power Loss adequately estimates the heat or thermal losses of impedance matcher 17, lamp voltage sensor 20 and glow discharge lamp 25 including their interconnect during actual plasma generation.

Losses in forward and reflected power detection circuits 12 and system interconnect up to impedance matcher 17 can be accounted for in the calibration of the forward power and reflected power signals.

After blind power measurements are made, the effective power (EP) or True Plasma Power™ (TPP) can be calculated while a plasma is present in the glow discharge lamp 25. One method of generating the controlled plasma is for processor 15 to adjust the RF output control signal to obtain the desired amount of effective lamp voltage as measured by lamp voltage sensor 20 with variable valve 37 closed. Processor 15 would open variable valve 37 allowing gas to flow into glow discharge lamp 25. When the amount of gas is sufficient, a plasma will form in glow discharge lamp 25 which will start to sputter the surface of sample 30.

True Plasma Power™ (TPP) can be calculated at any time by processor 15 through measurement of the forward power signal (FP), reflected power signal (RP), and effective RF voltage signal (Veff). TPP is then given by: TPP=FP−RP−PL.

For desirable operation of the plasma, two electrical parameters must be controlled as described previously. In one method, TPP and effective plasma current could be used to control the plasma. In this method, processor 15 would calculate the effective plasma current as one of the electrical parameters. Processor 15 would also calculate TPP as the second electrical parameter. As processor 15 alters the gas flow though variable valve 37, both TPP and effective plasma current would vary. To maintain the desired value of TPP, the processor would alter the value of the RF output control signal which will also alter the effective plasma current. To maintain the desired value of effective plasma current, processor 15 would alter variable valve 37 which will also alter the TPP. Since the RF output control signal and variable valve 37 both influence the desired operating parameters, iteration of the lamp pressure control signal and RF output control signal by processor 15 is necessary. Adjustments to the control signals by processor 15 are made based on the calculation of TPP and effective plasma current.

Although the use of effective plasma current is described, the system could also utilize lamp voltage sensor 20 for one of the electrical parameters on conductive samples or thin non-conductive layers on conductive backing. The effective lamp voltage monitor is always used for calculation of TPP even when not used directly as one of the two required electrical parameters controlling the plasma characteristics. Other combinations of TPP, effective lamp voltage, or effective plasma current can be used to control the plasma depending on the desired operating conditions and sample type. Integrated electron pulse area or integrated ion current area can also be used as an electrical parameter if calibration to an effective current level is not required.

Pressure transducer 40 can be used to improve start up time and reduce the number of iterations. If the approximate operating pressure for a given plasma characteristic is known, variable valve 37 can be pre-adjusted by processor 15 to obtain the desired operating pressure as measured by the pressure transducer 40.

Utilizing a glow discharge system like that shown in FIG. 12 allows for real time control of sputtering rates by controlling the plasma parameters utilizing effective lamp current and effective power without the need for measurement or calculation of the sample's actual RF potential. Thus, the method of using an integrated electron/ion pulse area for controlling plasma conditions allows for controlled analysis of conductive, non-conductive and layered materials without the need for estimation of plasma voltages. The method allows for control of sputter rates and plasma emissions that cannot be achieved using other methods such as capacitive divider calculations where actual thicknesses and dielectric constants are not known or predefined. The system also allows calibration of the effective lamp current to a known quantity using one of the methods described previously thereby providing correlation to well-known DC sputter rates and emission tables.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the claims as interpreted according to the principles of patent law, including the doctrine of equivalents.

We claim:

1. A glow discharge lamp system comprising:

a glow discharge lamp for ionizing a sample of a material to be analyzed in a plasma;

an RF power supply for supplying RF power to the glow discharge lamp at a power level selected in response to an RF output control signal;

a lamp current sensor for sensing a total lamp current and generating a total lamp current signal representative of the total lamp current over time; and a processor for receiving the total lamp current signal from said lamp current sensor and for supplying the RF output control signal to said RF power supply, wherein said processor determines an integrated pulse area of a pulse contained within the total lamp current signal and adjusts the RF power supplied to the glow discharge lamp in response to the integrated pulse area, wherein the pulse is one of an electron pulse and an ion pulse.

2. The glow discharge lamp system as in claim 1, wherein said processor is configured to:

continuously calculate a sum of the total lamp current signal;

determine a start time of the pulse;

determine an end time of the pulse; and determine the integrated pulse area by subtracting a value of the sum found at the start time of the pulse from a value of the sum found at the end time of the pulse.

3. The glow discharge lamp system as in claim 1, wherein said processor is configured to:

measure an effective plasma power of said glow discharge lamp; and adjust the pressure of the glow discharge lamp as to alter at least one of the effective plasma power and the integrated pulse area.

4. The glow discharge lamp system as in claim 1 and further comprising:

a memory for storing calibration data, wherein said processor reads the calibration data from said memory and uses the calibration data to convert the integrated pulse area into an effective plasma current.

5. The glow discharge lamp system as in claim 4, wherein said processor is configured to:

measure an effective plasma power of said glow discharge lamp, calculate an effective voltage by a quotient of the effective plasma power divided by the effective plasma current.

6. A method for controlling plasma conditions of a glow discharge lamp comprising:

measuring a total lamp current of the glow discharge lamp;

determining an integrated pulse area contained within the total lamp current using a processor;

measuring an effective plasma power of the glow discharge lamp; and adjusting a pressure of the glow discharge lamp as to alter at least one of the effective plasma power and the integrated pulse area, wherein the integrated pulse area is one of an integrated electron pulse area and an integrated ion pulse area.

7. A method of calibrating an integrated pulse area from a total lamp current of a glow discharge lamp system to a quotient of effective plasma power divided by effective voltage, wherein the integrated pulse area is one of an integrated electron pulse area and an integrated ion pulse area, the method comprising:

measuring effective plasma power, integrated pulse area, and effective voltage on a conductive sample at no fewer than one plasma operating point;

controlling the at least one plasma operating point by varying at least one of a pressure of the glow discharge lamp system and the effective plasma power;

using the quotient of effective plasma power divided by effective voltage to determine effective plasma current using a processor in communication with the glow discharge lamp system; and using the processor to create a mathematical function or table relating the integrated pulse area to the effective plasma current and storing the mathematical function or table in a memory device.

8. A method as in claim 7 where at least one plasma operating point consists of two different plasma operating points in order to determine both slope and intercept of the mathematical function or table.

9. A method as in claim 7 where at least one plasma operating point consists of multiple different plasma operating points in order to determine the mathematical function or table relating integrated pulse area to effective plasma current.

10. A method of calibrating an integrated pulse area from a total lamp current of a glow discharge lamp system to an effective plasma current, wherein the integrated pulse area is one of an integrated electron pulse area and an integrated ion pulse area, the method comprising:

measuring effective plasma power, integrated pulse area, and effective voltage on a conductive sample at no fewer than one plasma operating point;

controlling the at least one plasma operating point by varying at least one of a pressure of the glow discharge lamp system and the effective plasma power;

using a quotient of effective plasma power divided by effective voltage to determine effective plasma current using a processor in communication with the glow discharge lamp system; and using the processor to create a mathematical function or table relating the integrated pulse area to the effective plasma current and storing the mathematical function or table in a memory device.

11. A method as in claim 10 where at least one plasma operating point consists of two different plasma operating points in order to determine both slope and intercept of the mathematical function or table relating integrated pulse area to effective plasma current.

12. A method as in claim 10 where at least one plasma operating point consists of multiple different plasma operating points in order to determine the mathematical function or table relating integrated pulse area to effective plasma current.

13. A method for determining an integrated pulse area of a pulse contained within a total lamp current signal of a glow discharge lamp, wherein the pulse is one of an electron pulse and an ion pulse, the method comprising:

continuously calculating a sum of the total lamp current signal using a processor in communication with the glow discharge lamp;

determining a start time of the pulse;

determining an end time of the pulse; and determining the integrated pulse area using the processor by subtracting a value of the sum found at the start time of the pulse from a value of the sum found at the end time of the pulse.

14. A method for determining the integrated pulse area as in claim 13 where determining the start time of the pulse includes finding at least one of the first or second derivatives of the continuously calculated sum of the total lamp current and assigning the start time when the derivative(s) exceeds a predetermined value.

15. A method for determining the integrated pulse area as in claim 13 where determining the start time of the pulse includes finding at least one of a first derivative and a second derivative of the total lamp current signal and assigning the start time when the derivative exceeds a predetermined value.

16. A method for determining the integrated pulse area as in claim 13 where determining the end time of the pulse includes finding the derivative of the continuously calculated sum of the total lamp current and assigning the stop time when the derivative first equals zero after a start time has been determined.

17. A method for determining the integrated pulse area as in claim 13 where the total lamp current signal has been filtered to remove or minimize fundamental drive frequency contributions.

* * * * *